United States Patent [19]

Stritzl et al.

[11] Patent Number: 4,858,946

[45] Date of Patent: Aug. 22, 1989

[54] NON-SOLE DEPENDENT SKI BINDING

[75] Inventors: Karl Stritzl; Henry Freisinger, both of Vienna; Franz Luschnig, Traiskirchen, all of Austria

[73] Assignee: TMC Corporation, Baar, Switzerland

[21] Appl. No.: 116,730

[22] PCT Filed: Feb. 14, 1987

[86] PCT No.: PCT/EP87/00080

§ 371 Date: Nov. 30, 1987

§ 102(e) Date: Nov. 30, 1987

[87] PCT Pub. No.: WO87/04939

PCT Pub. Date: Aug. 27, 1987

[30] Foreign Application Priority Data

Feb. 17, 1986 [AT] Austria ..... 408/86

[51] Int. Cl.[4] ..... A63C 9/081; A63C 9/20

[52] U.S. Cl. ..... 280/618; 280/628

[58] Field of Search ..... 280/618, 628, 634, 626, 280/632

[56] References Cited

U.S. PATENT DOCUMENTS

| | | | |
|---|---|---|---|
| 3,876,219 | 4/1975 | Smolka et al. | 280/11.35 |
| 4,190,264 | 2/1980 | Himmetsberger et al. | 280/618 |
| 4,274,653 | 6/1981 | Himmetsberger et al. | 280/618 |
| 4,336,955 | 6/1982 | Schmidt | 280/618 |
| 4,531,758 | 7/1985 | Svoboda et al. | 280/628 |
| 4,533,155 | 8/1985 | Krob et al. | 280/628 |
| 4,607,859 | 8/1986 | Wittmann et al. | 280/634 |
| 4,681,338 | 7/1987 | Spitaler | 280/628 |

FOREIGN PATENT DOCUMENTS

| | | | |
|---|---|---|---|
| 378691 | 9/1985 | Austria . | |
| 3342155 | 5/1985 | Fed. Rep. of Germany . | |
| 3443243A | 6/1985 | Fed. Rep. of Germany | 280/618 |

*Primary Examiner*—Charles A. Marmor
*Assistant Examiner*—Tamara L. Finlay
*Attorney, Agent, or Firm*—Finnegan, Henderson, Farabow, Garrett & Dunner

[57] ABSTRACT

This safety ski binding includes a base plate adapted to be fastened to an upper side of the ski and supporting a vertical pivot. A sole plate is pivotably mounted on the vertical pivot and supports at its rear end a heel support having a sole support which is acted upon by a locking spring. The heel support includes a holding jaw at its front end. The sole plate is pushed by the locking spring in the direction of its central position.

An additional release of the ski boot is provided by movement of the heel support relative to the sole plate, as in the case of a pure horizontal load. A heel support has a bearing block which is pivotable with its base about a vertical axial member. The vertical axial member of the bearing block is fastened to the sole plate. A further roller is allocated to the bearing block which is pressed by an additional spring against a cam disposed at the base plate.

7 Claims, 4 Drawing Sheets

NON-SOLE DEPENDENT SKI BINDING

BACKGROUND OF THE INVENTION

The invention relates to a safety ski binding and, in particular, to a ski binding which facilitates release of a ski boot in response to a torsion fall.

A conventional safety ski binding is described in German Patent Publication No. DE-A1-33 42 155. The release of a ski boot from the ski binding disclosed in this publication performs unsatisfactorily in the event of a torsion fall. According to the conventional ski binding, when a sole plate supporting a ski boot is urged to swing laterally, the bias of the locking spring, which keeps the sole plate in the skiing position, is increased. Oftentimes, such bias may produce excessive force, particularly around the location of the skier's ankle.

SUMMARY OF THE INVENTION

Accordingly, it is an object of the present invention to eliminate this disadvantage and to provide a safety ski binding which ensures an additional release of the ski boot by movement of the heel holder relative to the sole plate in response to a pure horizontal load. A release of the heel holder may also be provided in response to a rearward torsion fall of the skier.

Additional objects and advantages of the invention will appear in the following description, and other objects and advantages will be obvious from that description. The stated objects and advantages of the invention may be realized by the apparatus and methods particularly pointed out in the appended claims.

To achieve the objects and purposes of the invention, a safety ski binding of this invention comprises a base plate adapted to be fastened to the upper side of the ski and supporting a vertical pivot. A sole plate is pivotally mounted on the pivot and includes at its rear end a heel holder having a sole support. The sole support is acted upon by a locking spring and supports a holding jaw at its front end. The sole plate is pushed by this locking spring in the direction of its central position by means of a roller. The heel holder support has a bearing block that is pivotable with its base about a vertical axle. The sole support and a spring fork receiving the locking spring are mounted on a transverse axle. A locking lever is mounted in the sole support on a further transverse axle having a nose which is detachably locked in the skiing position of the heel holder at the front side of the bearing block. The nose is acted upon by the locking spring via a pressure element. A tread spur, as is generally known from Austrian Patent Publication No. AT-A2-378 691, is linked to the sole support and is supported on the the sole support when the holding jaw is in the skiing position. The vertical axle for the bearing block is fastened to the sole plate. A further roller is allocated to the bearing block, which is urged by an additional pressure spring against a horizontal cam disposed on the base plate, thereby securing the base of the bearing block against a horizontal swing in the skiing position.

Also, in accordance with the present invention, the roller is mounted on a vertical axle, which is displaceably guided in a slot of the sole plate in the longitudinal direction thereof. This axle supports a horizontal locking pin which projects in the skiing position between the two prongs of a fork bent off from the base of the bearing block.

Further, in accordance with the present invention, the roller is acted upon by the locking spring and is mounted on the sole support. The roller is supported on a cam formed at a bent section of the base plate. The bent section of the base plate extends within a circular-arc-shaped oblong hole in the sole plate, the center of which is along the geometrical axis of the pivot.

Still further, in accordance with the present invention, the spring acting upon the roller is a pressure spring which is adjustable in its bias, such that the spring abutment remote from the roller is in the form of a piston which is mounted in the sole plate and secured against twisting. The piston can be displaced by means of a knurled screw, which is screwed into a threaded bore of a lug of the sole plate.

The accompanying drawings, which are incorporated in and constitute a part of this specification, illustrate one embodiment of the invention and, together with the description, explain the principles of the invention.

DESCRIPTION OF THE PREFERRED EMBODIMENT

Reference will now be made in detail to the present preferred embodiments of the present invention, examples of which are illustrated in the accompanying drawings.

Figure 1:
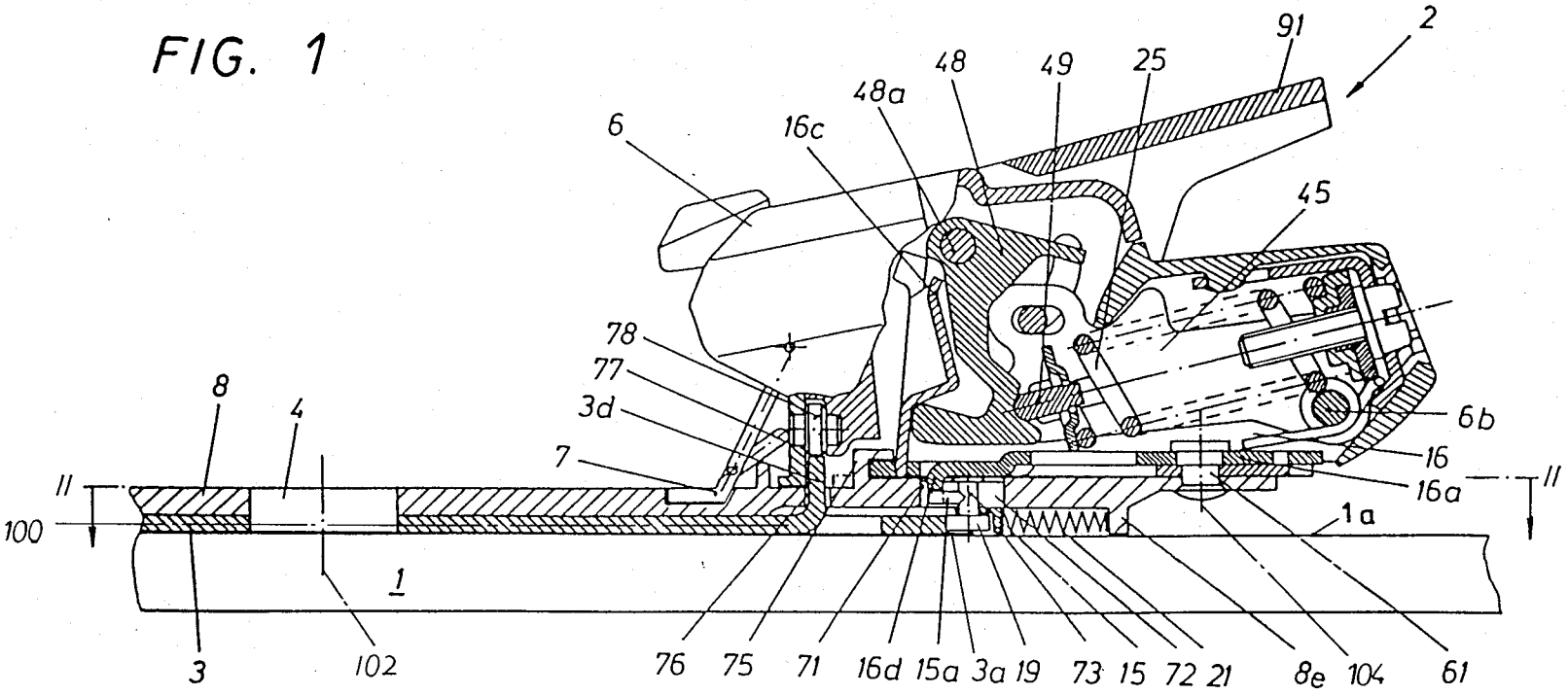
FIG. 1 is a vertical section of a ski binding according to the present invention and taken along line I—I of FIG. 2.

A preferred embodiment of the safety ski binding is shown in FIG. 1. In FIG. 1, a ski is generally designated by reference numeral 1 and a heel holder is identified by reference numeral 2. The ski binding has a base plate 3 having a first longitudinal axis 100 and adapted to be fastened to an upper surface of the ski 1*a*. The base plate 3 is provided with a vertical pivot axle 4 disposed along a second axis 102 substantially orthogonal to axis 100. A sole plate 8 is pivotally mounted on the pivot axle 4, which provides support for a ski boot (not shown).

Figure 2:
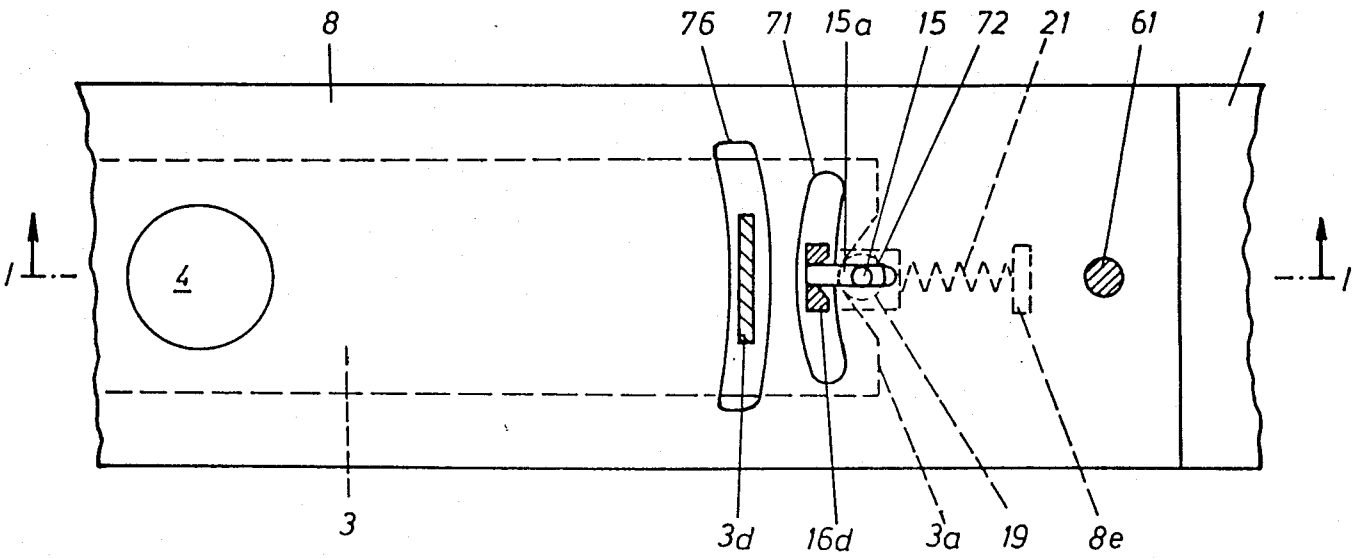
FIG. 2 is a plan view of the ski binding of the present invention taken along line II—II of FIG. 1.
Figure 3:
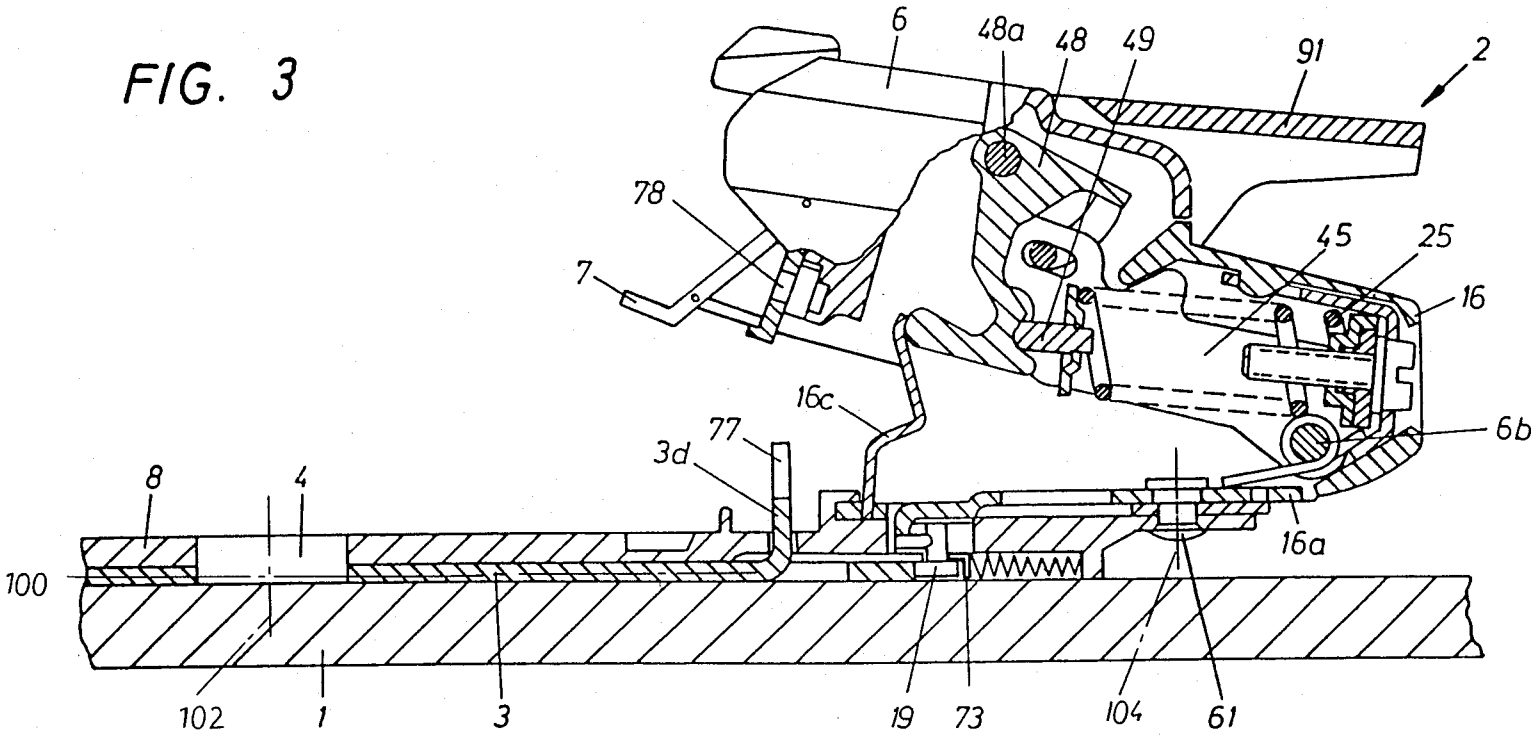
FIG. 3 is a vertical section of the present invention illustrating the released position of the heel support after a frontal fall.

As embodied herein and shown in FIGS. 1 (corresponding to a retaining position) and 3 (corresponding to a release position) the heel holder 2 includes a tread spur 7 and a sole support 6, the latter being mounted pivotally about a transverse axial member 6*b* disposed in a bearing block 16. The tread spur is located in a first position along the sole plate 8, as shown in FIG. 2. A spring fork 45 for receiving a locking spring is also mounted on the transverse axial member 6*b*. The bearing block 16 includes a front wall 16*c*, against which the end of a locking lever 48 rests, the locking lever 48 being mounted in the sole support portion 6 of heel holder 2 on a further transverse axial member 48*a*. A pressure element 49 acts on the locking lever 48 at its rear side, which is guided in slots of the spring fork 45 and is acted upon by the locking spring 25. The heel holder 2 is provided with a release lever 91 which can be pivoted about the same axial member 48*a* as the locking lever 48 and which facilitates removal of the ski.

As shown in FIG. 1, the base plate 3 supports a horizontal cam 3*a* at its rear end. A roller 19, acted upon by a pressure spring, cooperates with the horizontal cam 3*a*, as described in more detail hereinafter, and which serves to control the locking of the bearing block 16.

The sole plate 8 supports a vertical axial member 61 at its rear end, on which the base 16*a* of the bearing block 16 is mounted. A locking fork 16*d* which opens toward the base plate, is attached to the front end of the base 16*a*. The sole plate 8 has a circular-arc-shaped oblong hole 71, in which the locking fork 16*d* is guided, and a slot 72 extending in the direction of its longitudinal axis of the sole plate 8. The vertical axial member 61 is disposed along a third axis 104 is orthogonal to that is substantially orthogonal to the longitudinal axis of the sole plate 8. The roller 19, which is acted upon by the pressure spring 21, is mounted at a further vertical axial member 15, which is guided in the slot 72 of the sole plate 8. The axial member 15 is disposed at an angular steel member 73, against which the end of the pressure spring 21 rests. The other end of the pressure spring 21 is supported on a downwardly projecting lug 8*e* of the sole plate 8. The axial member 15 has a horizontally extending locking pin 15*a*, which is guided between the two prongs of the fork 16*d* in the normal skiing alignment of the ski binding The front end of the bearing block 16 is secured against lifting by a projection 75 mounted on the sole plate 8.

As embodied herein and shown primarily in FIG. 1, a second circular-arc-shaped oblong hole 76 is recessed in the sole plate 8. The center of the circular-arc-shaped hole 76 is aligned along the geometrical axis of the pivot 4. A bent section 3*d* of the base plate 3 projects with a vertical cam 77 into the hole 76 and serves as limiting means for limiting pivotal movement of the sole plate 8. A roller 78 is supported on the vertical cam 77, which is mounted on the sole support 6. The tread spur 7 is designed in a known manner to enable the sole support 6 to swing upward in the case of a rearward torsion fall. The skier generally is positioned on the tread spur 7 with the heel of the ski boot. In the entry position, the tread spur 7 is supported on the sole support 6.

If the skier falls forward the left end of the locking lever 48 in FIG. 1 slides along the front wall 16*c* of the bearing block 16 until the ski boot is released. In order to make it possible for the skier to re-enter the ski boot, the locking lever 48 of the heel holder 2 is retained in an open position by a catch.

In the case of a torsion fall of the skier the sole plate 8 is twisted about a pivot axle 4 against the force of the locking spring 25 which acts upon the roller 78. At the same time, the roller 19 rolls along the cam 3*a*. The roller 78 lifts the sole support portion 6 of heel holder 2 until the release point of the sole support portion 6 has been reached. If the sole plate 8 is sufficiently swung out, the locking pin 15*a* of the axial member 15 is pulled out from the slot between the two prongs of the locking fork 16*d*, allowing the heel support 2 to be pivoted about its vertical axial member 61 and providing lateral release of the ski boot.

Figure 4:
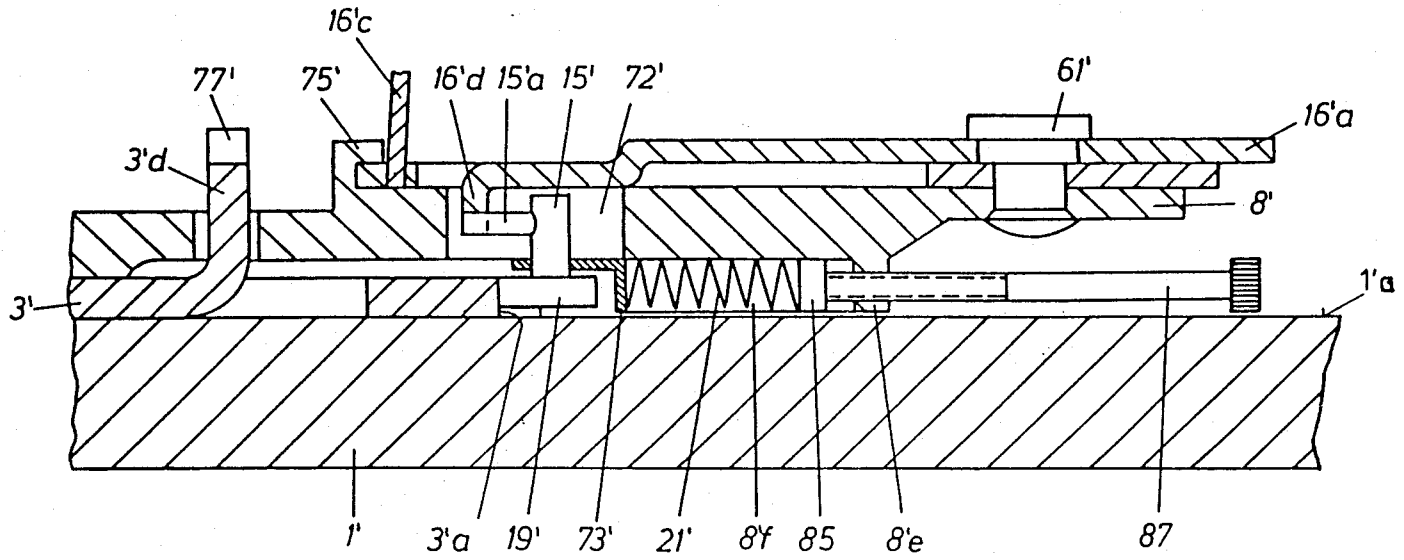
FIG. 4 is another embodiment of present invention depicting an adjustment mechanism beneath the heel support shown in FIG. 3.

Another embodiment of the present invention is shown in FIG. 4. In accordance with this embodiment, the pressure spring 21' urges a roller 19' and is supported on a piston 85 at its end remote from the roller. The piston 85 is guided in a slot 8'f of the sole plate 8' and is secured against twisting. A knurled screw 87 rests with its end against the side of the piston 85 remote from the pressure spring 21'. The piston 85 is screwed into a threaded bore of the lug 8'e of the sole plate 8'. If the bias of the pressure spring requires adjustment, the knurled screw 87 is rotated in the corresponding direction of rotation.

It will be apparent to those skilled in the art that modifications and variations can be made in the safety ski binding of the present invention without departing from the scope and spirit of the invention. For example, the pressure spring, which urges the roller against the cam of the base plate, may b replaced by a disk spring assembly. Therefore, it is intended that the present invention cover similar modifications and variations provided that they come within the scope of the appended claims and their equivalents.

We claim:

1. A ski binding comprising:

elongated base plate means having a first longitudinal axis, said base plate means including a substantially flat upper surface, and a first pivot axle extending from said upper surface along a second axis substantially orthogonal to said first axis;

elongated sole plate means for supporting the sole of a ski boot, said sole plate means pivotally mounted on said base plate for pivotal movement about said first pivot axle;

heel holder means for retaining a shoe heel in said binding, said heel holder means mounted on said sole plate means for pivotal movement about a third axis substantially parallel to said second axis, said heel holder means further including a locking portion extending in a direction towards said base plate means;

first cam means for limiting pivotal movement of said sole plate means about said first pivot axle, said first cam means, including a first cam surface and a first cam roller, and disposed between said base plate means and said heel holder means; and second cam means for limiting pivotal movement of said heel holder means about said third axis, said second cam means including a second cam surface, a second cam roller, and locking pin means, said second cam roller and said second cam surface disposed between said base plate means and said sole plate means to move said locking pin means into and out of contact with said locking portion of said heel holder means thereby permitting said pivotal movement of said heel holder means about said third axis.

2. A ski binding as set forth in claim 1, wherein said locking portion of said heel holder means includes a fork-like portion.

3. A ski binding as set for in claim 1, further including a pressure spring, said sole plate means including a lug portion, said base plate means including said second cam surface disposed on an edge portion thereof, said pressure spring disposed between said second cam roller and said lug portion to bias said second cam roller into contact with said second cam surface.

4. A ski binding as set forth in claim 3, further including a screw means, said lug portion including a threaded bore for cooperating with said screw means to selectively adjust the tension of said pressure spring.

5. A ski binding as set forth in claim 1, wherein said heel support means includes a bearing block portion, a sole support portion, and a tread spur, said sole support portion being pivotable on said bearing block for selective movement between a retaining position and a release position, said tread spur extending from said sole support portion and disposed to contact the sole of a ski boot to move said sole support portion to said retaining position.

6. A ski binding as set forth in claim 5, wherein said first cam means further moves said heel holder means to said release position in response to pivotal movement of said sole plate means about said first pivot axle.

7. A ski binding as set forth in claim 6, wherein said heel holder means further includes a locking lever, a front wall, and a locking spring, said locking spring biasing said locking lever toward said front wall to hold said sole support portion of said heel holder means in said retaining position.

* * * * *

UNITED STATES PATENT AND TRADEMARK OFFICE

CERTIFICATE OF CORRECTION

PATENT NO. : 4,858,946

DATED : August 22, 1989

INVENTOR(S) : STRITZL ET AL.

It is certified that error appears in the above-identified patent and that said Letters Patent is hereby corrected as shown below:

Claim 1, line 4, after "first" insert --vertical--; and

Please change the address of the assignee from "TMC Corporation, Baar, Switzerland" to --TMC Corporation, Baar/Zug, Switzerland--.

Signed and Sealed this

Seventeenth Day of July, 1990

*Attest:*

HARRY F. MANBECK, JR.

*Attesting Officer*

*Commissioner of Patents and Trademarks*